United States Patent [19]

Bassier et al.

[11] 4,136,998

[45] Jan. 30, 1979

[54] PROCESS FOR THE DISPOSAL OF THE RESIDUE OF THE EXHAUST GAS WASHERS OF FURNACES IN PARTICULAR BITUMINOUS COAL POWER STATIONS

[75] Inventors: Friedrich-Karl Bassier, Duisburg; Klaus Goldschmidt, Essen, both of Fed. Rep. of Germany

[73] Assignees: Ruhrkohle AG; Steag AG, both of Essen, Fed. Rep. of Germany

[21] Appl. No.: 762,965

[22] Filed: Jan. 27, 1977

[30] Foreign Application Priority Data

Jan. 31, 1976 [DE] Fed. Rep. of Germany ..... 2603699

[51] Int. Cl.[2] ..... E02D 3/14; E21F 15/00

[52] U.S. Cl. ..... 405/267; 249/11; 405/263; 423/555

[58] Field of Search ..... 61/36 B, 35, 0.5, 36 R, 61/63; 423/555; 299/11

[56] References Cited

U.S. PATENT DOCUMENTS

| | | | |
|---|---|---|---|
| 3,410,655 | 4/1968 | Rotter et al. | 423/555 |
| 3,574,648 | 4/1971 | Wirsching | 423/555 |
| 3,582,376 | 6/1971 | Ames | 106/109 |
| 3,786,639 | 1/1974 | Pineno et al. | 61/35 |
| 3,855,391 | 12/1974 | Selmeczi et al. | 423/555 |

FOREIGN PATENT DOCUMENTS

| | | | |
|---|---|---|---|
| 1158930 | 12/1963 | Fed. Rep. of Germany | 299/11 |
| 2161049 | 6/1973 | Fed. Rep. of Germany | 61/35 |

*Primary Examiner*—Mervin Stein
*Assistant Examiner*—A. Grosz
*Attorney, Agent, or Firm*—Andrus, Sceales, Starke & Sawall

[57] ABSTRACT

A process for disposing of the residue of exhaust gas washers by utilizing them as a structural material in mines. The sulfur in the exhaust gases is reacted with calcium compounds to form $CaSO_4.2H_2O$. The $CaSO_4.2H_2O$ is recrystallized to alpha-$CaSO_4.1/2H_2O$, conveyed underground, mixed with water, implaced and allowed to harden to form barricades or other structures in the mine.

6 Claims, 1 Drawing Figure

Figure 1:
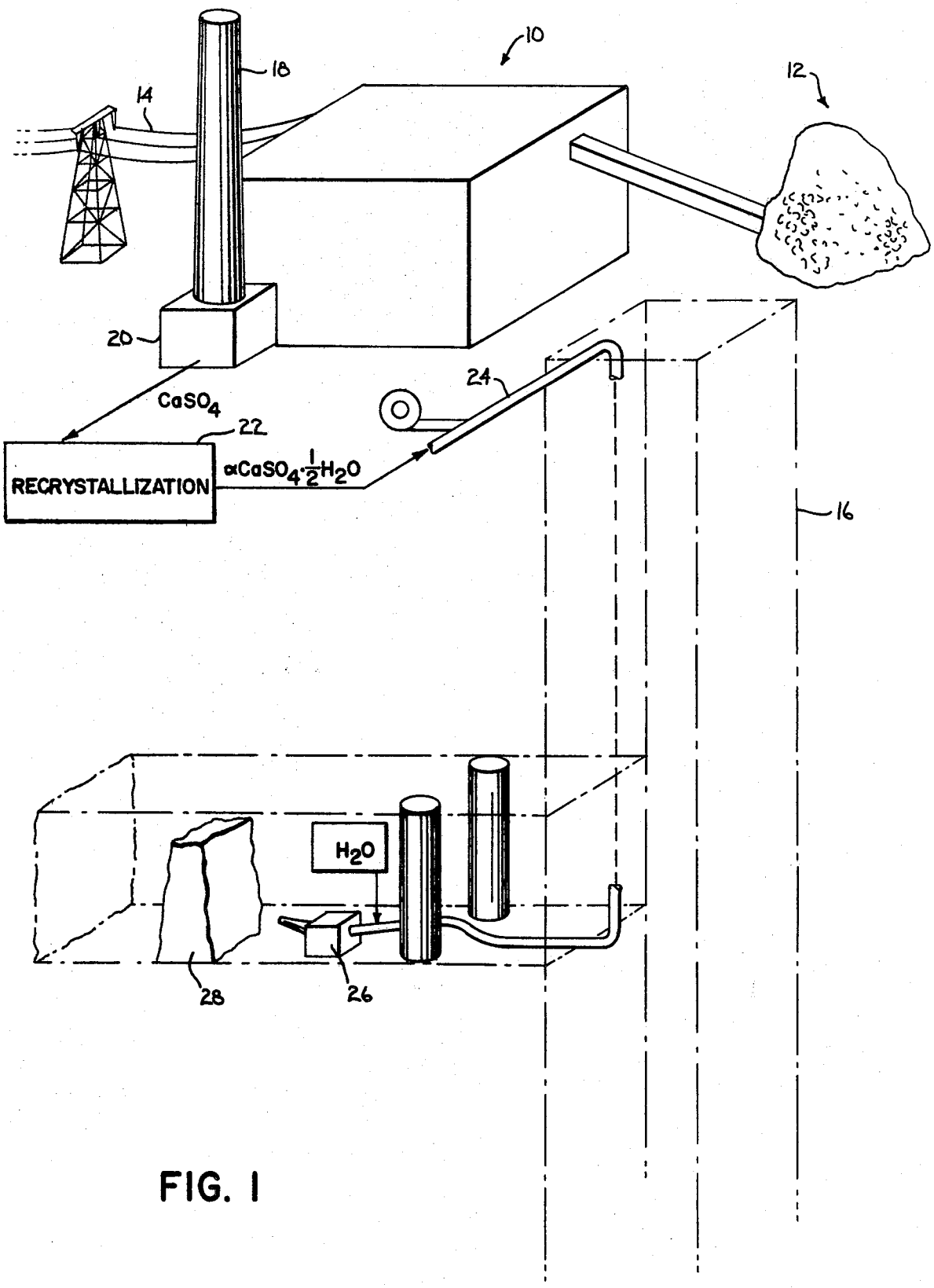

PROCESS FOR THE DISPOSAL OF THE RESIDUE OF THE EXHAUST GAS WASHERS OF FURNACES IN PARTICULAR BITUMINOUS COAL POWER STATIONS

The present invention is directed to a process for the disposal of the residue of the exhaust gas washers of furnaces, in particular, bituminous coal power stations by which the residue originating from the limestone or lime slurry is converted to calcium sulfate.

The washing of exhaust gases, in particular, those from power plants provides desulphuring through absorption with limestone ($CaCO_3$) or lime in the form of an oxide (CaO) or hydroxide ($Ca(OH)_2$). The resulting residues contain the discharged $SO_2$ mainly in the form of calcium sulphite ($CaSO_3 \cdot X_xH_2O$). The sulphite occurs in fluid form and contains, if the occasion arises, also dust, if the lime, respectively, limestone, is employed in wet separators which simultaneously serve for dust and $SO_2$ separation. The calcium sulphite can however also relatively dust-free occur if a dust cleaner is provided before the washer. The invention is applicable to such residues which are obtained principally in power plants, for example, in oil and coal, and particularly, bituminous coal, power stations.

The described residues already now occur in proportionately large quantities and in increasing quantities in the future, which, in particular, is due to the increasing requirements in the cleaning of the air. The residues are, however, because of their consistency and because of their chemical characteristics difficult to handle, in particular, if a mechanical treatment is not initially considered and on this account a disposal must be sought.

It is known to process the residues of the exhaust gas washers of bituminous coal power stations to gypsum. (Zeitschrift Brennstoff, Warme, Kraft 26 (1974) Nr. 3, S. 102–108). A pre-condition for this technique for the disposal of the residues is, however, that an active market for gypsum ($CaSO_4 \cdot 2H_2O$) be available in the applicable area. As a rule this is not the case because gypsum is available either out of natural deposits or occurs as a by-product of other chemical processes for example, by the hydrofluoric acid process.

It is further known to mix the residue of the exhaust gas washers of bituminous coal power stations with fly ash to produce stone-like granules and, if necessary, to subsequently pulverize the granules (DT-OS No. 2,400,350). In this connection it is thereby initiated that in this manner a useful binder or aggregate material can be produced which avoids the disposal of the residues, that is, mainly of the calcium sulphite. It has, however, up until now not been successful for such a recovered material to find a market use which is appropriate for the occurring quantities and permits economical separation.

It is also known to initially reduce the water content of the residue of the exhaust gas washers of power plants, then to mix the residue with a hydraulic binding agent or with water glass, to pelletize the thereby occurring mixture, and to subsequently further treat the green pellets. The treatment can occur in an air drying. One can also harden or even sinter the pellets (DT-OS No. 2,432,572) but, at present there exists likewise a not sufficiently large market for the hardened or dried pellets so that practically only the disposal of the air dried green pellets arises, for example, in slag heaps or the filling of gravel pits, and the like. It can further therefore be evident that these pellets must be protected from penetration of water through water-permeable surface layers (overburden, plastic film, and the like). Such preventative measures, however, increase the cost of the disposal of the pelletized separated residues.

If, however, the sulphite without reprocessing is retained stratified in a controlled storage to produce a water-supporting layer which on its part protects the ground water, there must be concern insofar as technical safety measures are connected that no soil mechanics cleavage is formed which could lead to a sliding of the slag. Such measures are however costly.

It is, to be sure, in the scope of the known utilization processes with which the residues are pelletized to have already been proposed to transfer the pellets to mines which are standing idle. Insofar as, for this purpose, idle pit shafts of bituminous coal mines are available for disposal, their volume is not sufficient to accommodate the residues for the period of time. One uses leached out salt supplies, as a rule, in preference to petroleum supplies. As for the rest, the filling of the large spaces of the underground operation of salt mines can not as optimally be found with relatively expensively recovered residues.

Certainly, the residues, through the addition of cement, can produce cement blocks in a correspondingly employed process. The market for concrete blocks at this time is, however, too small to utilize the occurring residues.

The invention proceeds from the initially described process which provides a conversion of the residue of the exhaust gas washers of bituminous coal power stations to calcium sulfate and which has proven practical as well as relatively economical. The invention has as its object to supply the residues in this manner of utilization which makes possible an economical disposal of the increasing amount of residues from the exhaust gas washers, in particular, of bituminous coal power stations, without requiring an immediately available utilization possibility for the gypsum produced out of the conversion.

In accordance with the invention this object is accomplished in that the recovered substratum is re-crystallized to alpha-sulfate hemihydrate (alpha-$CaSO_4$-$\frac{1}{2}H_2O$) and is implaced underground for mine protection, whereby the dried alpha-sulfate hemihydrate is conveyed and is treated with the addition of water.

Natural anhydrite ($CaSO_4$) has already been employed for the mine protection, namely, the production of section establishing barricades and for the backfilling of section structures in bituminous coal mines. Natural anhydrite has, in contrast with other binding materials, the advantage that it can be pnuematically conveyed, but requires for the attainment of sufficient strength an accelerator. The water is inserted two to three meters in front of the blow discharge, as a rule, through a ring nozzle. Natural anhydrite can be blown on the incline therethrough providing simple partitions. The use of synthetic anhydrite, that is, water-free calcium sulfate is also known which is initially changed in contact with water and certain catalysts to the dihydrate ($CaSO_4 \cdot 2H_2O$). Synthetic anhydrite is for the most part hydromechanically introduced resulting in a corresponding high revetment cost to implace as through the addition of rapid strengthers. ("Glauckauf" 111 (1975) Nr. 3, S.114,119).

It has now been discovered that the recovered dihydrate or gypsum ($CaSO_4 \cdot 2H_2O$) from the reconditioning of the residues of the exhaust gas washers of bituminous coal power stations is unfit in section establishing barricades for mine protection. In spite of the addition of accelerators, such a dihydrate achieves only an optimum strength of approximately 43 kp/cm$^2$ after one hour; this strength increases no further. The strength is insufficient either in its absolute magnitude or the period in which it is attained, for the requirements needed, in particular, in hydraulically bound material for a section establishing barricade.

The particular properties are illustrated in the attached Table 1 which reproduces testing of the dihydrate produced out of the residue of the wet washer of a bituminous coal power station along with properties of the anhydrite. The top two lines of the table describe $CaSO_4.2\ H_2O$; i.e. gypsum with its crystal water. The bottom six lines describe the anhydrite, $CaSO_4$; i.e. gypsum with its crystal water driven off. The left hand vertical columns show the starting amounts of the sulfate compounds; the amount of accelerator added, typically in the form of $K_2SO_4$; and the amount of water mixed with the sulfate compound all as by weight, in units such as pounds (p). Other vertical columns show crushing resistance and binding strength attained after various setting times.

In consonance with the invention the alpha-sulfate hemihydrate originates out of the dihydrate in accordance with already known processes. It is thus sufficient to disassociate the dihydrate and to re-crystallize the disassociated material in an autoclave at approximately 130° C. Thereby arises, as a rule, first the beta-hemihydrate and out of this the alpha-sulfate hemihydrate. Surprisingly, the crystal form of the alpha-sulfate hemihydrate has the property that it attains total significant ultimate strength in a proportionately short time span in the unpulverized condition with optimal water supply and without accelerators and it is particularly well suited, therefore, for the mine protection in barricades and for the back filling of mine structures. The specific details are illustrated in the analysis in Table 2, which reproduces the values obtained with a alpha-sulfate hemihydrate which is recrystallized out of the dihydrate, the dihydrate being obtained out of the recovery of the residues of an exhaust gas washer of a bituminous coal power station. The left hand columns of FIG. 2 show the starting amounts of alpha-sulfate hemihydrate; the amount of accelerator, if any; the amount of water added; and the setting time, in minutes. The remaining columns show the far higher crushing resistance and binding strength obtained with the alpha-sulfate hemihydrate, along with a tabulation of the properties of the water-hemihydrate mixture.

FIG. 1 shows the aforesaid process in graphic form. Power station 10 consumes coal 12 to supply electricity to power lines 14. Coal 12 may be obtained from a local mine 16. The sulfur bearing exhaust gases exiting power plant 10 in stack 18 pass through washer 20 containing a calcium compound. The sulfur bearing exhaust gases react to form a $CaSO_4$compound. The $CaSO_4$ so formed is dissassociated and recrystallized to form alpha-$CaSO_4.\frac{1}{2}\ H_2O$ in dry form, as in autoclave 22. The alpha-$CaSO_4.\frac{1}{2}\ H_2O$ in dry form is conveyed, as by pneumatic conveyor 24, to the interior of the mine 16 where it is mixed with water in nozzle apparatus 26 and implaced in the mine to form protective structures, such as barricade 28.

One has, up until now, utilized alpha-sulfate hemihydrate only for the processing of artificial gypsum obtained, for example, by the fluorine process. With this the re-crystallization process is, however, extraordinarily complicated because of its wash and separator stages required for the discharge material, and would not be suited in this form for the disposal of the residue. Surprisingly, it has been shown that the calcium sulfate from the reconditioning of the residues of exhaust gas washers aleady exists in a form which essentially simplifies the processing of the alpha-sulfate hemihydrate. It is thereby possible to provide profitability to the disposal of the residues in this way.

On this is also based the possibility that the alpha-sulfate process implements the utilization of the process heat of the power station either at the station or outside the power station, for example, in the coal pit in which the removed residue is deposited. This has a significant advantage for the operation of the power plant because therethrough additional environmental impact, and therewith connected obligation, as well as other impairment of the technical operation of the power plant can be avoided.

The process according to the invention has the advantage that it makes possible the removal of sufficient quantities of the residue of the exhaust gas washer. The consumption analyses of bituminous coal mines for materials which are suitable for mine protection show that already today the requirement in hydraulically setting materials of this type is so great that it cannot be fully met from the amounts realized from the reconditioning of residues.

The yearly growth rates of the requirements for hydraulically set materials in bituminous coal mines lies, at present, at approximately 20–30% so that projections indicate that the increasing residues, including those resulting from increasing demands for environmental protection, can be accommodated with the process of the present invention.

The process according to the invention is also economical, even though a separation of the sulfite-residues must, in each case, be undertaken, particularly in view of the high overall costs heretofore encountered in disposing of washer residues. Since bituminous coal mines, in particular, devote considerable attention to the characteristics of the hydraulically set material for mine protection, the process of the invention, which provides such materials having desirable characteristics from recovered residues, is particularly economical.

These advantages of the process according to the invention are supplemented with the advantage which results in the better processing possibilities of the alpha-sulfate hemihydrate underground. On the one hand, the accelerator is eliminated which, up until now, was required to be employed in considerable quantities with natural or artificial anhydrite. On the other hand, the alpha-sulfate hemihydrate is, with respect to hygrometric conditions, insensitive and sets first with the addition of water. It can, therefore, be easily transported and blown on the incline. Further, it is suited otherwise for the conveying and blowing apparatus already known and available underground.

Preferably, the alpha-sulfate hemihydrate is used without an acclerator, is pneumatically conveyed, and the water is at the conclusion of the transport added before the implacement.

Advantageously, there is a further property of the alpha-sulfate hemihydrate, which in accordance with the invention is taken to advantage, that the ultimate strength of the treatment is established through the proportion of the alpha-sulfate hemihydrate to water. This permits the proportion of the alpha-sulfate hemihydrate to water, and hence the resulting ultimate strength of the structure, to be established in accordance with the local conditions.

TABLE 1

| Anhydrite P | $K_2SO_4$ P | Water P | Water-Solids Ratio | Resistance To Crushing In kp/cm² With Respect To A Setting Time In Hours Of: 1 Hr. | 5 Hr. | 24 Hr. | 48 Hr. | 7 Days | Binding Strength In kp/cm² According To A Setting Time In Hours Of: 1 Hr. | 5 Hr. | 24 Hr. | 48 Hr. | 7 Days | Comments |
|---|---|---|---|---|---|---|---|---|---|---|---|---|---|---|
| 2000 | 40 ⅔ $FeSO_4$ ⅓ $K_2SO_4$ | 600 | 0,3 | — | — | 1,9 | 2,2 | 22,4 | — | — | 0,8 | 0,6 | 10,2 | $CaSO_4 \cdot 2H_2O$ |
| 2000 | 40 $K_2SO_4$ | 600 | 0,3 | — | — | 2,8 | 2,6 | 4,0 | — | — | 0,7 | 0,6 | 0,6 | |
| 1000 | 20 | 700 | 0,7 | 5,5 | — | 11,6 | — | — | 2,8 | — | 4,8 | — | — | $CaSO_4$ w/o $H_2O$ |
| 1000 | 20 | 800 | 0,8 | — | 52,4 | — | 44,4 | 48,8 | — | 23,6 | — | 18,0 | 18,0 | |
| 1000 | 10 ⅔ $FeSO_4$ ⅓ $K_2SO_4$ | 800 | 0,8 | 43,2 | 34,4 | 44,4 | 44,6 | — | 18,4 | 14,6 | 19,4 | 15,6 | — | |
| 1000 | 20 | 700 | 0,7 | 2,3 | — | 10,4 | — | — | 1,4 | — | 4,5 | — | — | |
| 1000 | 20 | 800 | 0,8 | — | 37,2 | — | 35,2 | 30,4 | — | 18,4 | — | 22,2 | 13,8 | |
| 1000 | 10 | 800 | 0,8 | 22,8 | 26,8 | 44,0 | 45,2 | — | 1,4 | 14,7 | 17,4 | 18,0 | — | |

—Not Measured

TABLE 2

| Alpha-Sulphate Hemihy-Drate P | $K_2SO_4$ P | Water P | Water-Solids Ratio | Setting Time Min | Resistance To Crushing In kp/cm² With Respect To A Setting Time In Hours Of: 1 | 3 | 5 | 24 | 48 | Binding Strength In kp/cm² According To A Setting Time In Hours Of: 1 | 3 | 5 | 24 | 48 | Character Of The Composition |
|---|---|---|---|---|---|---|---|---|---|---|---|---|---|---|---|
| 2000 | — | 400 | 0,2 | 5 | 216 | 326 | 256 | 177,0 | 406 | 48,0 | 78,5 | 70 | 67,8 | 65 | STIFF |
| 2000 | — | 600 | 0,3 | 10 | 174 | 249 | 266 | 254,0 | 312 | 50,5 | 72,5 | 76 | 90,0 | 80 | FLUID |
| 2000 | — | 800 | 0,4 | 12 | 104 | 171 | 180 | 155,7 | 166 | 40,5 | 59,0 | 63 | 64,6 | 58 | WATERY |
| 2000 | — | 1000 | 0,5 | 22 | 43 | 144 | 152 | 130,8 | 140 | 17,0 | 44,0 | 38 | 56,6 | 50 | HIGHLY FLUID |
| 2000 | — | 1200 | 0,6 | 27 | 44 | 108 | 116 | 128,0 | 132 | 18,0 | 46,0 | 48 | 52,0 | 47 | * |
| 2000 | 40 | 400 | 0,2 | 2 | 230 | — | 184 | 266,0 | 242 | 59,0 | — | 62 | 66,0 | 50 | VERY STIFF |
| 2000 | 40 | 600 | 0,3 | 3 | 186 | 158 | 166 | 184,0 | 194 | 58,0 | 57,0 | 58 | 53,4 | 50 | THICK |
| 2000 | 40 | 800 | 0,4 | 4 | 116 | 100 | 112 | 120,8 | 122 | 36,0 | 40,0 | 42 | 38,4 | 35 | FLUID |
| 2000 | 40 ⅔ $FeSO_4$ ⅓ $K_2SO_4$ | 1000 | 0,5 | 6 | 75 | 68 | 78 | 64,8 | 74 | 28,0 | 27,0 | 29 | 28,0 | 28 | WATERY |
| 2000 | 30 | 400 | 0,2 | 1 | 164 | — | 178 | 170,0 | 202 | 32,0 | — | 34 | 50,0 | 43 | VERY STIFF |
| 2000 | 30 | 600 | 0,3 | 2 | 164 | 220 | 204 | 192,0 | 204 | 51,0 | 65,0 | 56 | 57,0 | 58 | VISCOUS |
| 2000 | 30 | 800 | 0,4 | 3 | 122 | 140 | 150 | 119,0 | 124 | 44,0 | 51,0 | 53 | 39,6 | 43 | FLUID |
| 2000 | 30 | 1000 | 0,5 | 5 | 84 | 100 | 104 | 72,4 | 76 | 34,0 | 38,0 | 40 | 34,8 | 33 | WATERY |

—NOT MEASURED
*IT RELEASES VERY LARGE QUANTITIES OF WATER, BELOW SETTING

We claim:

1. A process for utilizing the residues of a thermal energy power plant washer for forming protective structures within a mine proximate to said power plant comprising the steps of:

reacting the sulfur bearing exhaust gases of the power plant with a calcium compound in the washer to form a $CaSO_4$ compound:

disassociating and recrystallizing substantially all of the $CaSO_4$ compound to form alpha-$CaSO_4 \cdot \frac{1}{2} H_2O$ in dry form by heating the $CaSO_4$ compound with thermal energy obtained from the power plant;

conveying the alpha-$CaSO_4 \cdot \frac{1}{2} H_2O$ in dry form to the interior of the mine;

mixing the alpha-$CaSO_4 \cdot \frac{1}{2} H_2O$ with water; and implacing the alpha-$CaSO_4 \cdot \frac{1}{2} H_2O$ within the interior of the mine for forming protective structures within the mine.

2. The process according to claim 1 wherein the disassociation and recrystallization occurs at a temperature of approximately 130° C.

3. The process according to claim 1 wherein the dry alpha-$CaSO_4 \cdot \frac{1}{2} H_2O$ is pneumatically conveyed.

4. The process according to claim 1 wherein the mixing step is further defined as mixing the alpha-sulfate hemihydrate with an amount of water determined accordance with the desired ultimate strength of the implaced hemihydrate.

5. The process according to claim 1 wherein the implacing step is further defined as forming mine protecting barricades in the mine.

6. The process according to claim 1 wherein the implacing step is further defined as back filling mine section structures.

* * * * *